US005551907A

United States Patent [19]

Davé

[11] Patent Number: 5,551,907

[45] Date of Patent: Sep. 3, 1996

[54] SYSTEM FOR ULTRASONIC LAP GRINDING AND POLISHING

[75] Inventor: Sandeep Davé, Bethel, Conn.

[73] Assignee: Hughes Aircraft Company, Los Angeles, Calif.

[21] Appl. No.: 213,393

[22] Filed: Mar. 14, 1994

[51] Int. Cl.[6] ..... B24B 1/00

[52] U.S. Cl. ..... 451/41; 451/165; 451/278; 451/287

[58] Field of Search ..... 451/165, 36, 41, 451/278, 283, 285, 287, 288, 159, 160

[56] References Cited

U.S. PATENT DOCUMENTS 5,099,614 3/1992 Arai et al. ..... 51/165 R 5,245,790 9/1993 Jerbic ..... 51/121

5,245,796 9/1993 Miller et al. ..... 51/283 R

*Primary Examiner*—Bruce M. Kisliuk

*Assistant Examiner*—Eileen P. Morgan

*Attorney, Agent, or Firm*—W. C. Schubert; W. K. Denson-Low

[57] ABSTRACT

A method is disclosed for grinding and polishing a substrate (20). An abrasive slurry (26) is applied to the surface (22) of the substrate (20). A lap (28) is moved across, and in engagement with, the surface of the substrate (20) in the medium of the abrasive slurry (26). Ultrasonic energy is mechanically applied to the surface (24) of the substrate such that half wave resonance occurs substantially at the surface (22) of the substrate (20). In this manner, a thickness of material is removed at an enhanced rate from the surface (22) of the substrate (20).

9 Claims, 1 Drawing Sheet

SYSTEM FOR ULTRASONIC LAP GRINDING AND POLISHING

BACKGROUND OF THE INVENTION

1. Field of the Invention

The present invention relates generally to lap grinding and polishing of substrates including optics and, more particularly, to a system utilizing ultrasonic energy to enhance the rate of removal of micron-thicknesses of material from a substrate. Throughout this disclosure, the terms "lap" and "lapping" and their derivatives will be used to refer to a process of producing an extremely accurate, highly finished, surface by means of a block charged with abrasive. The block, or lap, may be a pitch-covered metal tool or a metal tool covered with pitch-impregnated felt. Lapping is intended to encompass sequential operations of grinding and polishing. The amount of material typically removed by lapping does not exceed approximately 0.0002 inches to 0.0005 inches.

2. Description of the Prior Art

Conventional grinding and polishing operations rely primarily on two mechanisms: mechanical and chemical. The mechanical removal mechanism consists of a shear of the surface atoms when the lap provides a high local pressure at the contact points between the abrasive and the optic surface. This is aided by a chemical removal mechanism, which for most cases, entails the formation of a soft hydrolyzed layer by reaction with water that is subsequently removed by the abrasive.

While ultrasonics abrasion is known for drilling, it has not previously been used for polishing or for use in semiconductor processing applications.

SUMMARY OF THE INVENTION

A method is disclosed for grinding and polishing a substrate. An abrasive slurry is applied to the surface of the substrate. A lap is moved across, and in engagement with, the surface of the substrate in the medium of the abrasive slurry. Ultrasonic energy at a power level up to approximately 2,000 watts and at a frequency in excess of 15 kHz is mechanically applied to the surface of the substrate such that half wave resonance occurs substantially at the surface of the substrate. In this manner, a thickness of material being approximately in the range of 0.0002 inches and 0.0005 inches is removed at an enhanced rate from the surface of the substrate. In another embodiment, the substrate is defined as having first and second opposed surfaces with an abrasive slurry being applied to the first surface. The lap is moved across, and in engagement with, the first surface of the substrate in the medium of the abrasive slurry while the ultrasonic energy is mechanically applied to the second surface of the substrate such that half wave resonance occurs substantially at the first surface of the substrate.

The system of the invention employs ultrasonic energy to aid in the grinding and polishing of optics, glass, ceramics, metal and plastics. An ultrasonic generator associated with a polishing puck generates cavitation in the surrounding liquid-borne abrasive slurry. Ultrasonics can produce cavitation, that is, formation of gas bubbles in a liquid during a rarefaction cycle. Upon collapse of the gas bubbles during the compression cycle, tremendous pressures are generated. The quantity of bubbles ranges in the thousands within a small volume of water. These forces can therefore propel abrasive slurry against the surface of the substrate.

The ultrasonic head can be at the top of the lap, or can be applied to the back of the optic. In both cases, the design would effect cavitation at the surface of the optic, that is, the half wave resonance would occur at the surface.

A primary purpose of this invention is to greatly enhance removal rates during operations calling for grinding and polishing of optics over conventional methods. The advantage of using this methodology is application of forces produced by ultrasonics, which can reach approximately 1000 atmospheres locally, to propel the abrasive slurry against the optic surface. With the right combination of energy and abrasive properties, grinding and polishing can be effected without exceeding acceptable damage levels in the optic. With conventional methods, high removal rates have generally resulted in producing unacceptable damage levels in the optic.

Another advantage of this process is that it is a means of supplementing removal mechanisms where loose abrasive slurries are used. These include conventional grinding, pitch lap polishing, and computer controlled grinding/polishing laps.

It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts through the disclosure.

DETAILED DESCRIPTION 0F THE PREFERRED EMBODIMENTS

Figure 1:
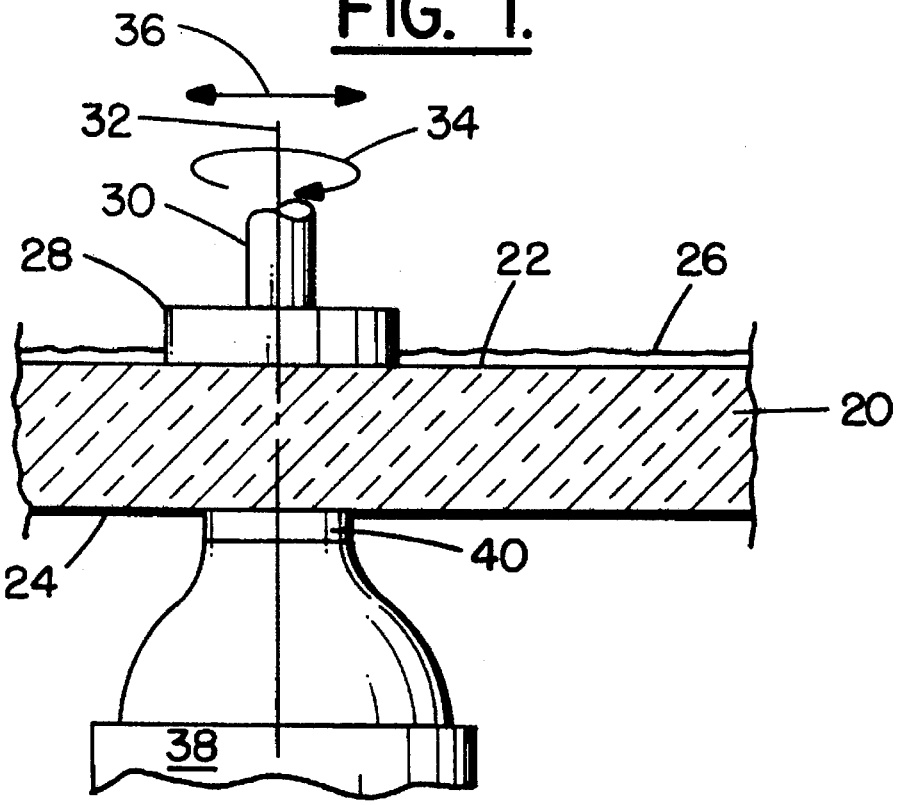
FIG. 1 is a side view, partly in section, illustrating a first embodiment of the invention.

FIG. 1 illustrates substrate 20 which may be made of a variety of materials including glass, ceramics, metal, and plastics. It is desired to grind and polish at least one surface of the substrate which is depicted as having opposed surfaces 22, 24. An abrasive slurry 26 is suitably applied to, and overlies, the surface 22. The slurry may be composed of abrasive particles in a liquid medium. A grinding or polishing lap 28 is submerged in the slurry 26 and moved across the surface 22 via an integral operating shaft 30. Lap 28 may be of conventional construction, preferably of metal, and shaped so as to assure a desired contour as a result of the operation on the surface 22. The lap 28, which may be disk-shaped may be rotated about an axis 32 as indicated by an arcuate arrowhead 34 in FIG. 1. Alternatively, the lap 28 may be moved to and fro in the manner indicated by a double arrowhead 36. Additionally, the grinding and/or polishing operation simultaneously performed by the lap 28 may be performed by a complex motion combining rotation about the axis 32 and to and fro motion in the directions indicated by the double arrowhead 36.

At the same time that the lap 28 is in engagement with the surface 22 for grinding and/or polishing operations, ultrasonic energy is mechanically applied to a surface 24 which is opposite and generally coextensive with surface 22. This is achieved by means of an ultrasonic generator 38 which may be of a conventional construction applying the energy so produced through a suitable tip member 40 which is held in engagement with the surface 24 and centered under lap 28. For purposes of the invention, the ultrasonic generator 38 is capable of generating up to approximately 2000 watts of power at a frequency in excessive of 15 kilohertz. The ultrasonic generator is so operated as to focus its energy such that half-wave resonance occurs substantially at the surface 22.

By operating the lap 28 and the ultrasonic generator 38 as a system, a thickness of material removed from the surface 22 being approximately in the range of 0.0002 inches and 0.0005 inches can be achieved at a rate which was not previously obtainable.

The use of ultrasonics for drilling into materials is well known, but its application for grinding and polishing of substrates such as optics has not been previously considered.

Ultrasonics is the term used to describe certain types of compressional (pressure) waves which are actually sound waves having a frequency above the audible range. These waves are produced when an object vibrates in a material medium in which the constituent particles are close enough to interact with each other. This condition is satisfied in solids, liquids and gases at normal and higher pressures, but not by a vacuum or a highly rarefied gas.

A compressional wave is caused by to-and-fro vibration of the particles in its path, which in turn results in periodic pressure variations. The characteristics of these waves are frequency (the number of vibrations occurring each second), amplitude (the maximum displacement of the vibrating particle), and wavelength (the distance the sound can travel in the time it takes to make one complete vibration).

Compression waves to which the human ear is sensitive have frequencies between 20 hertz and 15,000 hertz, and are termed "audible sounds". Vibrations with frequencies above approximately 15,000 hertz are too fast to be detected by the human ear (although certain animals can hear them, for example bats) and are termed "ultrasonic". The upper frequency limit of ultrasonic vibrations is set by the generators available and, at the present time, is about $10^{10}$ (ten thousand million) hertz.

Ultrasonic vibrations have a wide range of applications. Important among these are ultrasonic cleaning, drilling and non-destructive testing of metal castings. When generated in liquids, ultrasonic waves produce cavitation by the creation of minutes spaces within the liquid. These spaces implode with a force that is extremely effective in removing dirt and dust particles from surfaces requiring cleaning. The effect is also used for emulsifying immiscible liquids (that is, liquids which will not normally mix, like oil and water), and for the removal of air bubbles from liquids prior to casting.

Holes of any shape can be bored in a surface by the action of ultrasonic waves imposed on a rod in contact with the surface to be drilled. The cutting action is achieved with the aid of abrasive powder, and the resulting hole is the shape of the vibrating rod. The principles of reflection of ultrasonic waves provide the basis for the detection of flows voids, cracks and other irregularities nondestructlvely in large metal castings.

The systems for the production of ultrasonic energy are termed ultrasonic generators. There are a variety of constructions and materials utilized for ultrasonic generators. Quartz is a particularly desirable material in the high frequency ultrasonic region because of its excellent mechanical qualities. Other piezoelectric crystals may be used, however, as for example, Rochelle salt and ammonium dihydrogen phosphate. Barium titanate is an electrostrictive material which by prepolarization assumes properties which are similar to piezoelectric materials.

It was earlier mentioned that cavitation results when ultrasonic energy is applied in a liquid. More to the point, if a sound wave is impressed upon a liquid and the intensity is increased, a point will be reached at which cavitation occurs. Cavitation is the formation of a gas bubble in the liquid during the rarefaction cycle. When the compression cycle occurs, the gas bubble collapses. During the collapse, tremendous pressures are produced. The pressure may be on the order of several thousand atmospheres. Thousands of these small bubbles are formed in a small volume of the liquid.

As briefly noted above, the drilling of glass, ceramics and metals is now performed by means of ultrasonics. A tip through which the energy is transmitted sets up cavitation in a surrounding liquid-borne abrasive slurry. The forces produced by the cavitation bubbles propel the abrasive slurry against the material being drilled. The result is that glass, ceramics, and metals are penetrated in the matter of a few seconds. The tip may be any shape as contrasted to circular drills. Typically, the ultrasonic generator system operates as a half-wave resonator. This would place the compression wave maximum at the surface being worked thereby achieving maximum energy at the work surface. The "half wave" is the reference to the mid point of the energy cycle or period. The dimensions of the resonator are usually such that resonance occurs at 15 kilohertz, or higher. The amplitude at the drilling tip is increased by the use of a mechanical transformer in the form of a tapered rod.

Figure 2:
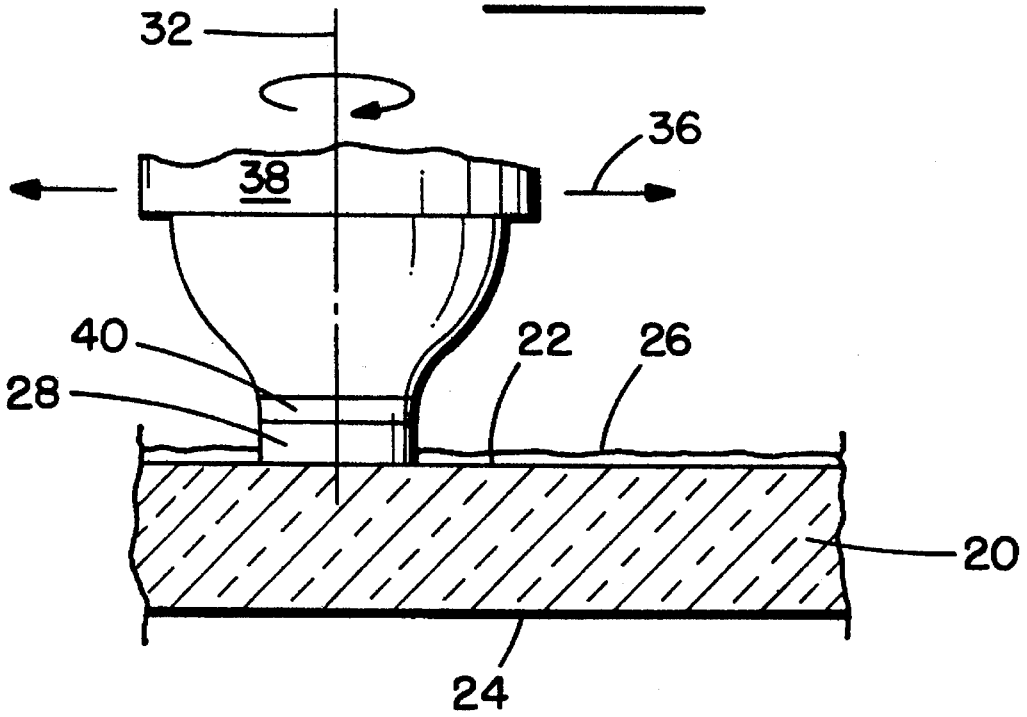
FIG. 2 side view illustrating another embodiment of the invention.

FIG. 2 illustrates another embodiment of the invention. In this instance, all activity takes place at the surface 22 of the substrate 20. The abrasive slurry 26 is applied to the surface 22 in any suitable manner and the grinding and polishing lap 28 under the ultrasonic head 40 is operatively engaged with the surface 22 acting through the slurry. Again, the lap 28 may be rotated about its axis 32 or translated along the surface 22 in a to and fro manner depicted by the double arrowhead 36, or by a combination of rotation and translation. Simultaneously, the ultrasonic generator 38 is engaged with the surface 22 of the substrate 20 through the lap 28 such that half wave resonance occurs substantially at the surface 22.

As with the first embodiment, the embodiment of the invention depicted in FIG. 2 results in an enhanced rate of removal of the material from the substrate 20.

I claim:

1. A method of lapping or polishing a substrate to an optical finish, said substrate having first and second opposed surfaces, the method comprising the steps of:

introducing an abrasive slurry to the first surface of the substrate;

moving a lap across, and in engagement with, the first surface of the substrate in the medium of the abrasive slurry; and applying ultrasonic energy in one instance to the second surface of the substrate and in another instance to the first surface of the substrate at a level up to approximately 2,000 watts at a frequency in excess of 15 kHz and at a location generally centered with the lap such that, in either instance, half wave resonance occurs substantially at the first surface thereof whereby the surface of the substrate engaged by the lap is polished to an optical finish.

2. A method as set forth in claim 1 wherein the substrate is an optic.

3. A method as set forth in claim 1 wherein the substrate is a material selected from the group consisting of quartz, glass, ceramics, metal, and plastics.

4. Apparatus for lapping a substrate having first and second opposed surfaces comprising:

a lap movable across, and in engagement with, one of the surfaces of the substrate in the medium of an abrasive slurry to selectively remove material from the first surface of the substrate;

means for generating ultrasonic energy at a level up to approximately 2,000 watts at a frequency in excess of 15 kHz; and mechanical transformer means for applying the ultrasonic energy to one of the surfaces of the substrate at a location generally centered with said lap such that half wave resonance occurs substantially at the first surface of the substrate.

5. Apparatus for lapping a substrate as set forth in claim 4 wherein the substrate is an optic.

6. Apparatus for lapping a substrate as set forth in claim 4 wherein the substrate is a material selected from the group consisting of quartz, glass, ceramics, metal, and plastics.

7. A method of lapping a surface of a substrate comprising the steps of:

introducing an abrasive slurry to the surface of the substrate;

moving a lap across, and in engagement with, the surface of the substrate in the medium of the abrasive slurry to selectively remove material from the first surface of the substrate;

generating ultrasonic energy at a level up to approximately 2,000 watts at a frequency in excess of 15 kHz; and mechanically applying the ultrasonic energy to the surface of the substrate at a location generally centered with the lap such that half wave resonance occurs substantially at the surface of the substrate.

8. A method of lapping as set forth in claim 7 wherein the substrate is an optic.

9. A method of lapping as set forth in claim 7 wherein the substrate is a material selected from the group consisting of quartz, glass, ceramics, metal, and plastics.

* * * * *